United States Patent [19]

McNeill

[11] Patent Number: 4,522,039

[45] Date of Patent: Jun. 11, 1985

[54] ICE CUBE MACHINE CUBE CUTTERS

[76] Inventor: John L. McNeill, P.O. Box 2211, Victoria, Tex. 77901

[21] Appl. No.: 546,706

[22] Filed: Oct. 28, 1983

[51] Int. Cl.[3] ..... F25C 5/02

[52] U.S. Cl. ..... 62/320; 225/4; 225/97; 241/DIG. 17

[58] Field of Search ..... 62/320; 241/DIG. 17, 241/266; 225/4, 97, 103

[56] References Cited

U.S. PATENT DOCUMENTS

| | | | |
|---|---|---|---|
| 2,123,827 | 7/1938 | Eyrick et al. | 241/266 X |
| 2,598,430 | 5/1952 | Pownall | 62/320 X |
| 2,721,452 | 10/1955 | Brandin et al. | 62/320 |
| 2,949,752 | 8/1960 | Bayston | 62/320 |
| 3,759,061 | 9/1973 | Nilsson et al. | 62/352 |
| 3,913,374 | 10/1975 | Esser et al. | 225/103 X |

*Primary Examiner*—William E. Tapolcai

[57] ABSTRACT

An ice making machine with an improved cube cutter is disclosed. A pair of oscillating pivotal cutter bars are disposed adjacent and beneath vertical ice making columns. The cutter bars are arranged to pivot in opposite directions so that as a rod or tube of ice falls therebetween, it is cut off into a cube, which then falls between the cutters into an appropriate receptacle.

13 Claims, 9 Drawing Figures

Fig. 2A
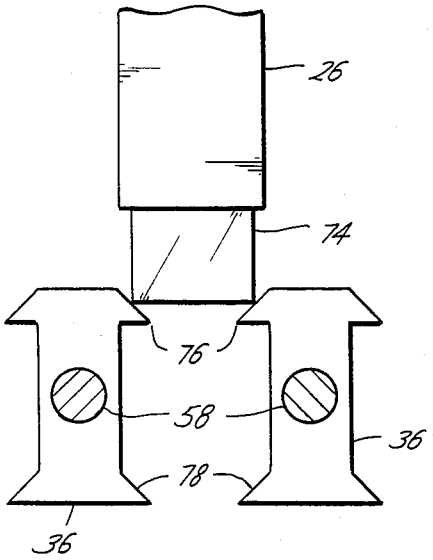
Fig. 2B
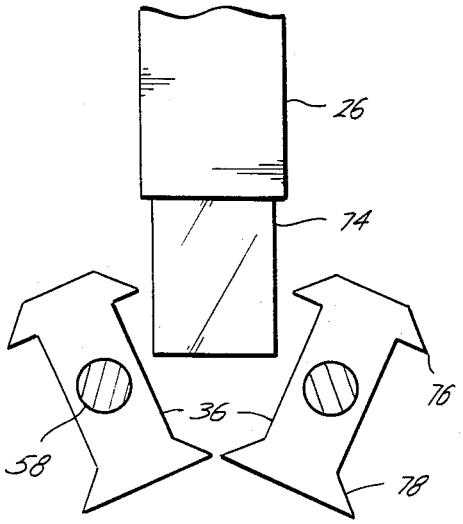
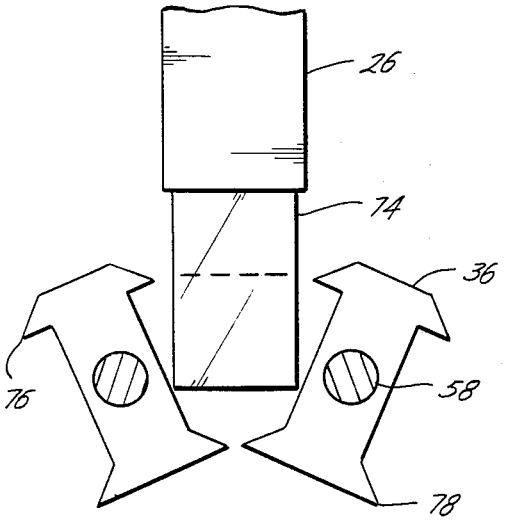
Fig. 2C
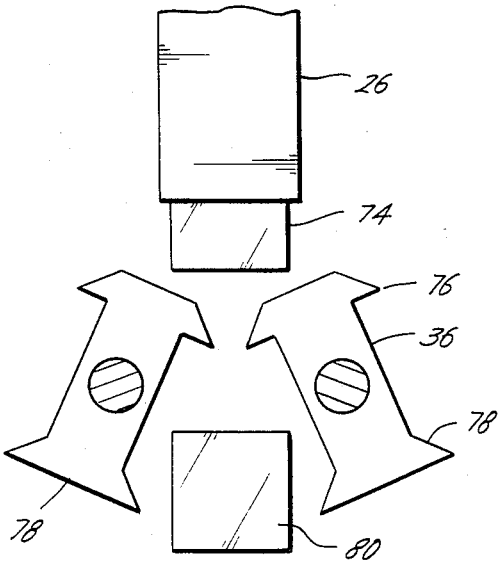
Fig. 2D

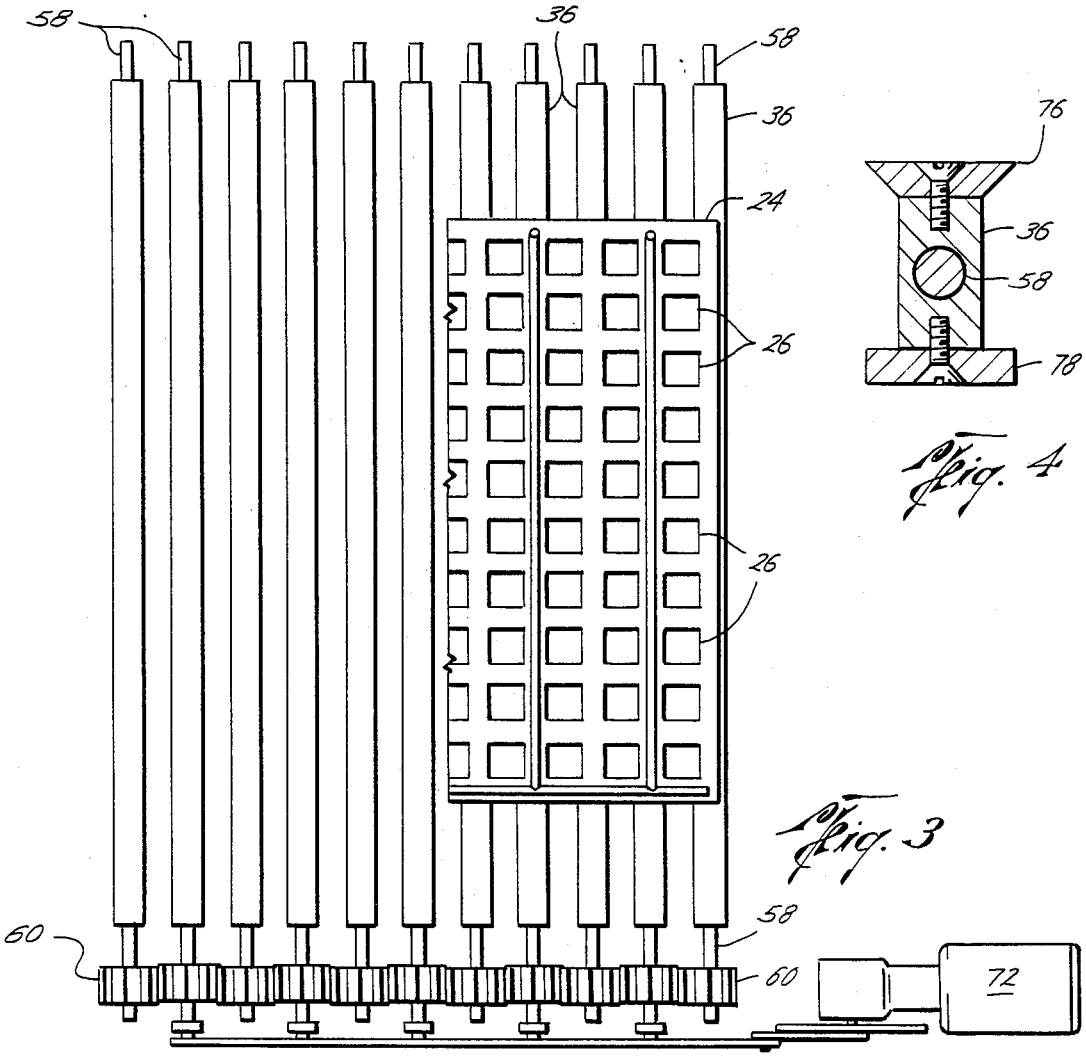
Fig. 3
Fig. 4
Fig. 3A
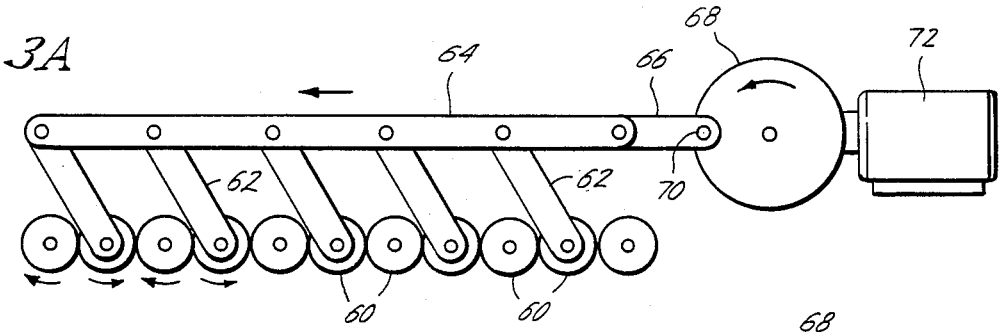
Fig. 3B
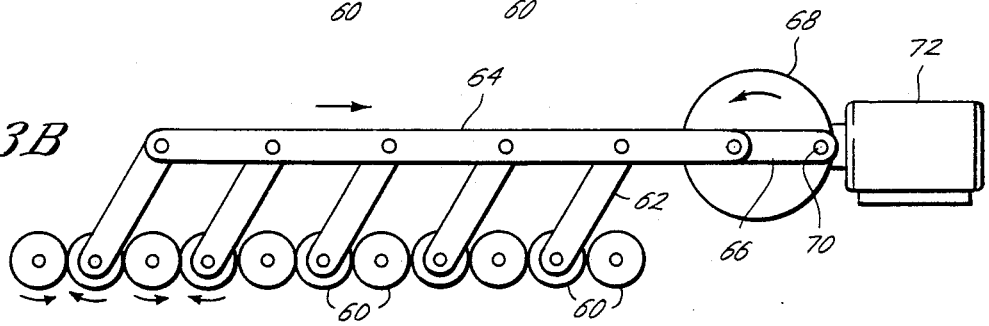

ICE CUBE MACHINE CUBE CUTTERS

BACKGROUND OF THE INVENTION

Ice making machines utilize a variety of cutting devices in order to separate vertical columns of ice into cubes or chunks. Typically, such machines use horizontal reciprocating cutters, or rotating knives to cut or break the descending ice column into cubes. Such mechanisms are illustrated in the Gruner, U.S. Pat. No. 2,397,347; Wilbushewich, U.S. Pat. No. 2,967,402; Bayston, U.S. Pat. No. 2,949,752; Rear, U.S. Pat. No. 2,585,498 and Readall, U.S. Pat. No. 2,637,177.

The present invention is directed to an improved ice making machine with an ice cube cutter which will quickly and efficiently cut sections or cubes from a descending column of ice, in order to produce smaller particles of ice for a wide variety of uses. It is important to provide relatively uniform cubes of ice, for aesthetic purposes. It is equally important to prevent sideways stresses on the ice-generating headers, while at the same time, providing a cutter mechanism which is simple to maintain, manufacture, and to resharpen. This is accomplished in the present invention by means of parallel oscillating pivoting cutter bars, which not only serve to determine the length of the cubes, but also to cut them off.

SUMMARY OF THE INVENTION

The present invention is directed to an improvement in an ice making machine with ice cutters which may be utilized with a variety of conventional ice machines to provide uniform cubes or chunks of ice.

One or more pairs of horizontally disposed cutter bars are arranged beneath a vertical tube ice making machine. The cutter bars are operated in one or more pairs, and are arranged to pivot below the output of the tubes in which the columns of ice are formed. A suitable reciprocating means is utilized to pivot the upper edges of the cutter bars toward each other in order to cut or pinch off the columns of ice as they descend, into uniform pieces. When the bottom edges of the cutter bars pivot toward each other, the descending columns of ice fall between the cutters, so that the length of the cube is thus determined.

Although the term "cube" is utlized in this application, it should be understood that the shape of the ice piece may not be a mathematical cube. Instead, it may simply be a uniform piece. Further, if utlized with an ice making machine which has rectangular, oval, or cylindrical ice generating tubes, then the particle which is provided by the cutters herein described may be rectangular, or a section of a cylinder, or even a section of a hollow tube. Thus, it is an object of the present invention to provide improved cutters for generating relatively uniform cubes of ice from a vertically-arranged tubular ice making machine by providing two or more horizontal cutter bars which pivot beneath the generator tubes to cut the ice into cubes as it descends therefrom.

It is a further object of the invention to provide one or more pairs of cutters, which may be mounted so that while one pair of cutters is cutting the descending ice column into cubes, the adjacent cutters are allowing the columns to descend to a predetermined length therebetween.

It is still a further object of the present invention to provide cutter bars which are so arranged as to prevent a descending ice column from passing past the cutter bars without having been cut, thereby gauging the length of the cube being cut without the use of stop plates, and independent of the speed of action of the cutters.

Another object of the present invention is to provide cutter bars which will cut the vertical ice columns without imparting any sideward stresses onto the ice-generating tubes of the ice making machine.

Other and further objects, features and advantages will be apparent from the following description of the presently preferred embodiment of the invention, given for the purpose of disclosure, and taken in conjunction with the accompanying drawings, where like character references designate like parts throughout the several views.

BRIEF DESCRIPTION OF THE DRAWINGS

FIGS. 2A–2D are a series of four partial end views illustrating the operation and cutting action of the pivoting cutter bars;

FIG. 3 is a partial top sectional view taken along the line 3—3 of FIG. 1, looking down upon an array of cutter bars mounted beneath the ice-generating tubes;

FIGS. 3A and 3B are partial side views showing the lever and gear mechanism used to oscillate the pivoting cutter bars; and FIG. 4 is a partial end view showing a modified form of cutter bar.

DESCRIPTION OF THE PREFERRED EMBODIMENT

Figure 1:
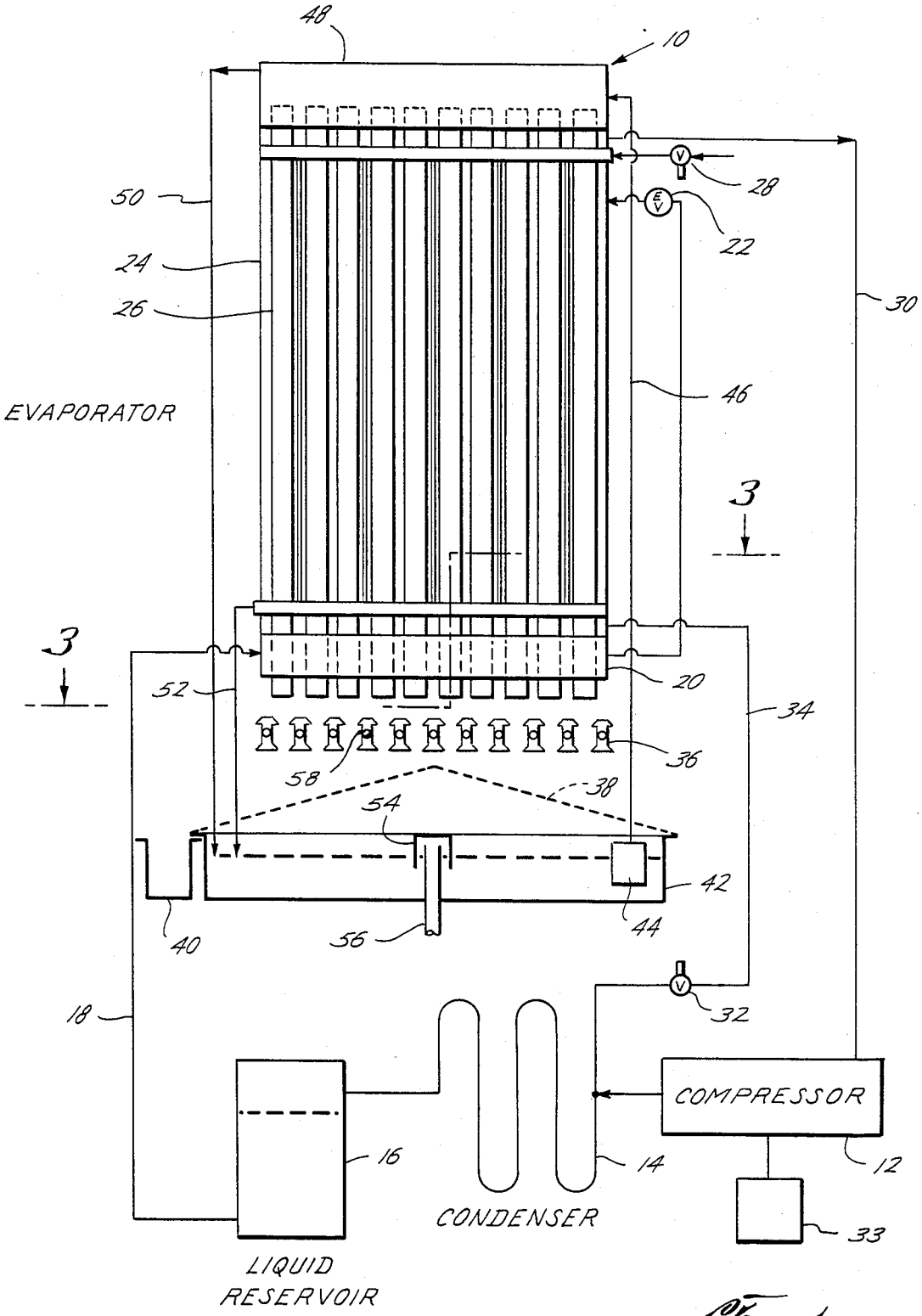
FIG. 1 is a general schematic drawing illustrating the refrigeration apparatus, ice cube-generating mechanism, and cube separator.

Referring now to the drawings, and particularly to FIG. 1, a general schematic diagram of the ice making machine is disclosed by the reference numeral 10, and generally includes a compressor 12, which compresses a suitable refrigerant and discharges it to a condenser 14, where it is liquified and discharged into a liquid reservoir 16. The liquid refrigerant passes through line 18 to a heat exchanger 20, and then to the expansion valve 22. Upon leaving the expansion valve, the refrigerant is vaporized within the evaporator 24. This expansion creates the cooling which is utilized to freeze water which is admitted into the tubes 26, within the evaporator by means of the water valve 28. The expanded refrigerant is withdrawn from the evaporator 24 through the suction line 30, where it returns to the compressor 12, to be recycled.

When the water has been frozen into ice, then it is ready to be harvested, and this is done by defrosting the ice tubes 26. During the defrost cycle, a defrost valve 32 is opened which allows hot compressed gasses from the compressor 12 to flow to the evaporator 24 through line 34 until the tubes 26 are warm enough to allow the ice columns within them to slide downwardly in the tubes 26. Note that the cutting action of the pivotally-mounted cutter bars 36 imposes no side stresses upon the ice column 74 or the tube 26.

After the tubes 26 are warmed sufficiently, the columns of ice slide vertically downwardly, until they come to the cutter bars 36, where they are cut into cubes. The cubes then fall to the separator screen or grid 38, where they slide to an appropriate receptacle 40. Any water which is generated as a result of this process falls through the screen 38 into the reservoir 42. This water may be recirculated by the water pump 44, up water line 46 to the water box 48 where it is mixed with the makeup water coming through the valve 28. Any overflow will go back to the reservoir through line 50. External condensate will fall to the reservoir 42 through line 52. An automatic siphon 54 maintains the water level automatically in the reservoir 44 and discharges to the drain line 56.

A control device 33 is utilized to interconnect with the compressor 12, defrost valve 32, water makeup valve 28, pump 44, cutter motor 72, and ice receptacle 40, in a conventional manner to control the sequence and timing of operations.

The refrigeration cycle operates in a conventional manner, as illustrated by the patents mentioned hereinabove. Also illustrated in such patents are appropriate timing circuits, temperature controls, and the like, which operate in a known manner to produce columns of ice.

Referring now to FIG. 3, a partial top view, partially in section, is shown wherein the evaporator 24 is situated above the cutter bars 36. The evaporator 24 has a series of rectangular tubes 26, situated therein. It is inside these rectangular tubes where the water is frozen into ice, and then when defrosted, it slides down the tube towards the cutter bars 36. The tubes 24 are arranged in a line so that a pair of cutter bars is situated on each side of the line of tubes 26. As will be hereinafter described, each of the inner cutter bars 36 does double duty, and serves to cut the ice column which descends from the tubes on either side of that bar.

At either end of each cutter bar is a journal or bearing 58 which serves to hold the cutter bar in alignment parallel to the row of tubes 26. Beyond one end of each cutter bar, and mounted on an extension thereof is a gear 60. Each cutter bar has such a gear, and all of the gears mesh so that pivoting of one cutter bar will result in pivoting of all of the cutter bars.

Referring now to FIGS. 3A and 3B, the operating mechanism for pivoting the cutter bars back and forth is more clearly shown. Note that a lever 62 is attached to every other cutter bar 36 so that oscillation of the lever will pivot the cutter bar back and forth. At the same time, the gears 60 will transmit the oscillating motion to the remainder of the cutter bars 36 so that each bar will pivot toward and then away from the adjacent bar. Pivotally interconnecting each of the levers 62 is a drive shaft 64. Pivotally connected to the drive shaft 64 is a connecting rod 66, which is attached to a drive disk 68 by a suitable wrist pin 70. The drive disk 68 is in turn attached to a gear motor 72, which rotates the disk 68, thus, ultimately resulting in the reciprocating pivoting action of the cutter bars 36.

Referring now to FIGS. 2A through D, a partial sectional end view of the cutter bar 36 is shown with the icegenerating tube 26 thereabove. The pair of cutter bars are spaced apart so that the column of ice 74 may be accommodated between the cutter bars 36 as hereinafter described. Each cutter bar has a cutting edge 76 extending outwardly from either side of the top. Each cutter bar 36 also has a stop 78 extending outwardly from either side of the bottom of the bar.

In operation during the harvest cycle, and comparing FIG. 2B to FIG. 2A, when the cutter bars 36 are pivoted outwardly away from the column of ice 74, the column will slide downwardly through the tube 26, until it contacts the cutter bar 36 or the stop 78 at the bottom of the cutter bar, depending upon the details of construction. This is seen in FIG. 2C. Then, the cutter bars are pivoted in the opposite direction, so that the cutting edges 76 come toward each other, as seen in FIG. 2D, thereby cutting the column of ice 74, breaking loose a cube 80, which then falls from the area now opened between the stops 78. Meanwhile, the remaining column of ice cannot fall downwardly below the cutting edges 76, and instead rests on the top of the cutter bar 36 as further ice feeds downwardly from the tube 26. Then the cutter bars begin to pivot outwardly, as seen by comparing FIGS. 2D and 2A and the cycle begins again. The cutter bars are pivotally oscillated for a period of time determined either by means of a timer, or other sensing device, so long as there is ice descending from the tube 26 to be cut.

To vary the lengths of the cubes cut from the column of ice 74, the spacing between the cutter bars 36, or the shape of the stops 78 may be adjusted. Similarly, the shape of the tube 26 may be varied, as mentioned above, to generate other shapes, generically called cubes herein. Notice that the cutter bars are used to gauge the length of the ice cube when pivoted in one direction, and at the same time to cut the ice in an adjacent column.

It will be apparent that every other cutter bar does not require a lever 62 in order to transmit the forces between the cutter bars to sever the ice. The number of levers 62 is a matter of good mechanical design. Also note that the tube 26 does not need to be square, but instead may be rectangular, oval, cylindrical, or other desired form, and the ice formed therein need not be solid, but may be hollow. It is only necessary that the tube 26 be sized so that the column of ice 74 will slide between the cutter bars for the desired length when cutting edges are pivoted away from each other, as shown in FIG. 2B.

Referring now to FIG. 4, a modification of the cutter bar 36 is shown wherein the cutting edges 76 are at the upper end instead of the lower end of the extension. Further, the stop 78 is squared off, rather than being beveled as in FIG. 2. Finally, the cutter bar is here shown made in three pieces, rather than as a single piece, to illustrate that replaceable elements may easily be utilized for both the stop and cutting edge functions. Here both the cutting edge 76 and the stop 78 are shown screwed to the central portion of the cutter bar.

The advantages of a removable cutting edge 76 are to simplify sharpening, replacement, and manufacture. Depending upon the shape and spacing of the cutter bars, the stop 78 may be more or less pronounced, or even eliminated.

The present invention, therefore, is well adapted to carry out the objects and obtain the ends and advantages mentioned, as well as others inherent therein. While a presently preferred embodiment of the invention has been given for the purpose of disclosure, numerous changes in the details of construction and arrangement of parts may be made which will readily suggest themselves to those skilled in the art and which are encompassed within the spirit of the invention and the scope of the appended claims.

What is claimed is:

1. An ice cube making machine including a plurality of individual ice generating tubes extending vertically and means for forming ice columns in said tubes, the improvement comprising:

at least one pair of pivotally mounted cutter bars disposed beneath the ice generating tubes, the bars being arranged to pivot toward and away from each other, oscillating means coupled to said cutter bars for pivoting the same toward and away from each other, said cutter bars being arranged generally horizontally and having a cutting edge disposed adjacent to an upper portion thereof and arranged in an opposed relation to the cutting edge of the other cutter bar, said cutter bars also including means for supporting the ice columns descending from said tubes as the cutting edges pivot away from each other and for releasing the cubes cut from the lower ends of each ice column whereby ice descending from the tubes may be cut into cubes as the cutter bars oscillate toward each other to cut said ice by the action of said cutting edges on the opposite sides thereof.

2. The invention of claim 1 wherein the ice-generating tubes are arranged in one or more lines, and the cutter bar pairs are disposed beneath each such line, on either side thereof.

3. The invention of claim 2 wherein said means for supporting the ice columns includes a stop ledge at the bottom of the bar.

4. The invention of claim 2 wherein the bars are arranged to pivot toward and away from each other by means of gears.

5. The improvement in ice cutters for use with an ice making machine of the vertical tube type, having a plurality of aligned individual vertical ice column forming tubes, including:

at least one pair of horizontally arranged, pivotally mounted cutter bars, the bars being arranged in a parallel opposed relation and set equidistant from the center of ice columning forming tubes, cutting means disposed adjacent an upper portion of each cutter bar and means for supporting an ice column disposed adjacent to the lower portion of at least one cutter bar, oscillating means coupled to the cutter bars, and arranged to pivotally oscillate the cutter bars toward and away from each other, whereby the cutting means will sequentially engage the opposite sides of columns of ice fed from the tubes for cutting the same into cubes.

6. The invention of claim 5 wherein the ice forming tubes are arranged in one or more lines, and the cutter bars pairs are disposed beneath each such line, on either side thereof.

7. The invention of claim 5 wherein said cutting means includes a cutting edge at the top of the bar, and said supporting means includes a stop ledge at the bottom of the bar.

8. The invention of claim 7 wherein said oscillating means includes gears.

9. The invention of claim 7 wherein the cutting edge at the top of the cutter bar is removable from the cutter bar.

10. An ice cube making machine including at least one ice column forming tube extending vertically and means for forming ice in said tube, said tube having a lower end through which a column of ice will decend, the improvement comprising:

a pair of cutting means disposed below said tube and on the opposite sides thereof, said cutting means each including an elongate cutting edge facing inwardly toward said decending ice column and extending generally normal to the axis thereof, said cutting means being mounted for movement of said cutting edges inwardly toward said ice column, oscillating means connected to said cutting means for simultaneously moving said cutting edges toward and away from each other, ice column support means positioned below said tube and coupled to said oscillating means for supporting an ice column decending from said tube as said cutting edges move toward each other, said cutting edges being positioned to engage the opposite side of said supported ice column and in substantially the same plane for cutting an ice cube therefrom, said column support means being operable by said oscillating means to release said ice cube after said cube has been severed from said column by said cutting means.

11. The ice cube making machine set forth in claim 10 wherein said ice column support means is mounted on at least one of said cutting means.

12. The ice cube making machine set forth in claim 10 wherein said cutting means are each mounted for pivotal movement about a substantially horizontal axis, said cutting means being displaced from said axis, said oscillating means being operative to pivot simultaneously said cutting means for moving said cutting edges inwardly toward said supported ice column.

13. The ice cube making machine set forth in claim 12 wherein there is an ice column support means mounted on each cutting means and disposed on the side of said pivot axis opposite to said cutting edges.

* * * * *